US006615969B2

(12) United States Patent
Trenner

(10) Patent No.: US 6,615,969 B2
(45) Date of Patent: Sep. 9, 2003

(54) MECHANICAL COIN CHECKER

(75) Inventor: Dietmar Trenner, Berlin (DE)

(73) Assignee: Walter Hanke Mechanische Werkstätten GmbH & Co. KG (DE)

( * ) Notice: Subject to any disclaimer, the term of this patent is extended or adjusted under 35 U.S.C. 154(b) by 0 days.

(21) Appl. No.: 09/930,045

(22) Filed: Aug. 15, 2001

(65) Prior Publication Data

US 2002/0020602 A1 Feb. 21, 2002

(30) Foreign Application Priority Data

Aug. 17, 2000 (DE) ..... 100 42 167

(51) Int. Cl.[7] ..... G07D 7/00
(52) U.S. Cl. ..... 194/203; 194/202
(58) Field of Search ..... 194/203, 202, 194/247, 260, 261, 287, 288, 289; 453/39

(56) References Cited

U.S. PATENT DOCUMENTS 2,580,590 A * 1/1952 Polsen et al. ..... 194/344
3,589,493 A * 6/1971 Hall ..... 194/334
3,592,308 A * 7/1971 Hall ..... 194/335
3,845,849 A * 11/1974 Andersson ..... 194/202
4,243,133 A * 1/1981 Nicolaus ..... 194/203
4,629,051 A 12/1986 Abe ..... 194/261
6,155,399 A * 12/2000 Bruner ..... 194/203

FOREIGN PATENT DOCUMENTS

GB 2 123 196 A 1/1984

* cited by examiner

*Primary Examiner*—Donald P. Walsh
*Assistant Examiner*—Mark J. Beauchaine
(74) *Attorney, Agent, or Firm*—Young & Basile, P.C.

(57) ABSTRACT

A mechanical coin checker is proposed having a coin channel which has a running rail for the coin to run down, in or at which channel checking arrangements are provided to check the properties of the coins, having a coin acceptance shaft and a return shaft, disposed below the running rail, to return coins which are not accepted. The running rail has in the running direction of the coin a recess into which coins which are too thin slide and possibly fall into the return shaft. In front of the coin acceptance shaft is disposed a detent pawl, which is rotatably mounted at a flap forming a part of the coin channel. A detent wire, which is pivotable about a portion of its longitudinal axis, co-operates with its one end region with the detent pawl and is disposed with its other end region below the recess, in such a way that when a coin slips through the recess, the detent wire pivots and takes the detent pawl with it into the coin channel to engage at least one integrally formed arm.

6 Claims, 3 Drawing Sheets

MECHANICAL COIN CHECKER

BACKGROUND OF THE INVENTION

1. Field of the Invention

The invention relates to a mechanical coin checker used in coin operated machines like washing machines, coin operated gaming machines, automatic ending machines and the like.

2. Description of the Prior Art

A large number of mechanical coin checkers are known in prior art which have in the region of their coin running channel, which joins onto the coin slot, a sensor arrangement which checks whether the coin is genuine and admissible. The sensors check e.g. the dimensions of the coin, and where the mechanical dimensions of the coin to be checked are identical, they have to be distinguished by means of their metallic properties. Magnetic checking arrangements are known for this purpose. To check the dimensions, there are limitations formed by rails or the like which take into account the diameter or the thickness of the coin. The coin channel has for example a lower running rail down which the coin runs, being supported with its upper edge against a rail. If the coin is too small it falls through below the rail and reaches a return channel. A recess is incorporated in the lower running rail in the longitudinal direction, such that a coin which is too thin slips into this recess and then falls into the return channel. However it sometimes happens that the coin becomes stuck in the recess and it has been shown that in this case there has been manipulation from the outside so that when a non-admissible, too thin coin or disc is inserted, which slides into the recess of the running rail, from outside a wire or a strip of cardboard or the like is inserted into the coin channel, with which implement the coin or disc which has become stuck is pushed forward so that it reaches the acceptance channel or the acknowledgement region.

SUMMARY OF THE INVENTION

An object of the present invention, is to improve the mechanical coin checker and to make available an additional measure which prevents passing a non-admissible coin into the acknowledgement region. Another object is to prevent one type of manipulation realized pushing a coin in the coin channel from outside by means of a tool into the acceptance channel.

According to the present invention the mechanical coin checker has a coin channel which has a running rail for the coin to run down, in or at which channel checking arrangements are provided to check the properties of coins, having a coin acceptance shaft and a return shaft, disposed below the running rail, to return coins which are not accepted, the running rail having in the running direction of the coin a recess into which coins which are too thin slide and possibly fall into the return shaft, wherein in front of the acceptance shaft a detent pawl is disposed which is rotatably mounted on a flap forming a part of the coin channel, and because a detent wire, pivotable about a portion of its longitudinal axis, co-operates with its one end region with the detent pawl, and with its other, bent end region is disposed below the recess, in such a way that when a coin slips through the recess, the detent wire, as a result of the weight of the coin acting on the bent end region, pivots about the longitudinal axis, and thus the other end of the detent wire comes into contact with the detent pawl and swivels the latter in the direction of the coin channel, whereby an arm engages in the coin channel. Thus the coin channel is blocked towards the acknowledgement region, such that even by manipulation from outside through the coin slot by means of a tool, such as a strip of cardboard or the like, the coin cannot be pushed into the acceptance channel.

BRIEF DESCRIPTION OF THE DRAWINGS

An embodiment of the invention is represented in the drawing and is explained in greater detail in the following description showing other objects and advantages.

The figures show.

DETAILED DESCRIPTION OF THE PREFERRED EMBODIMENT

Figure 1:
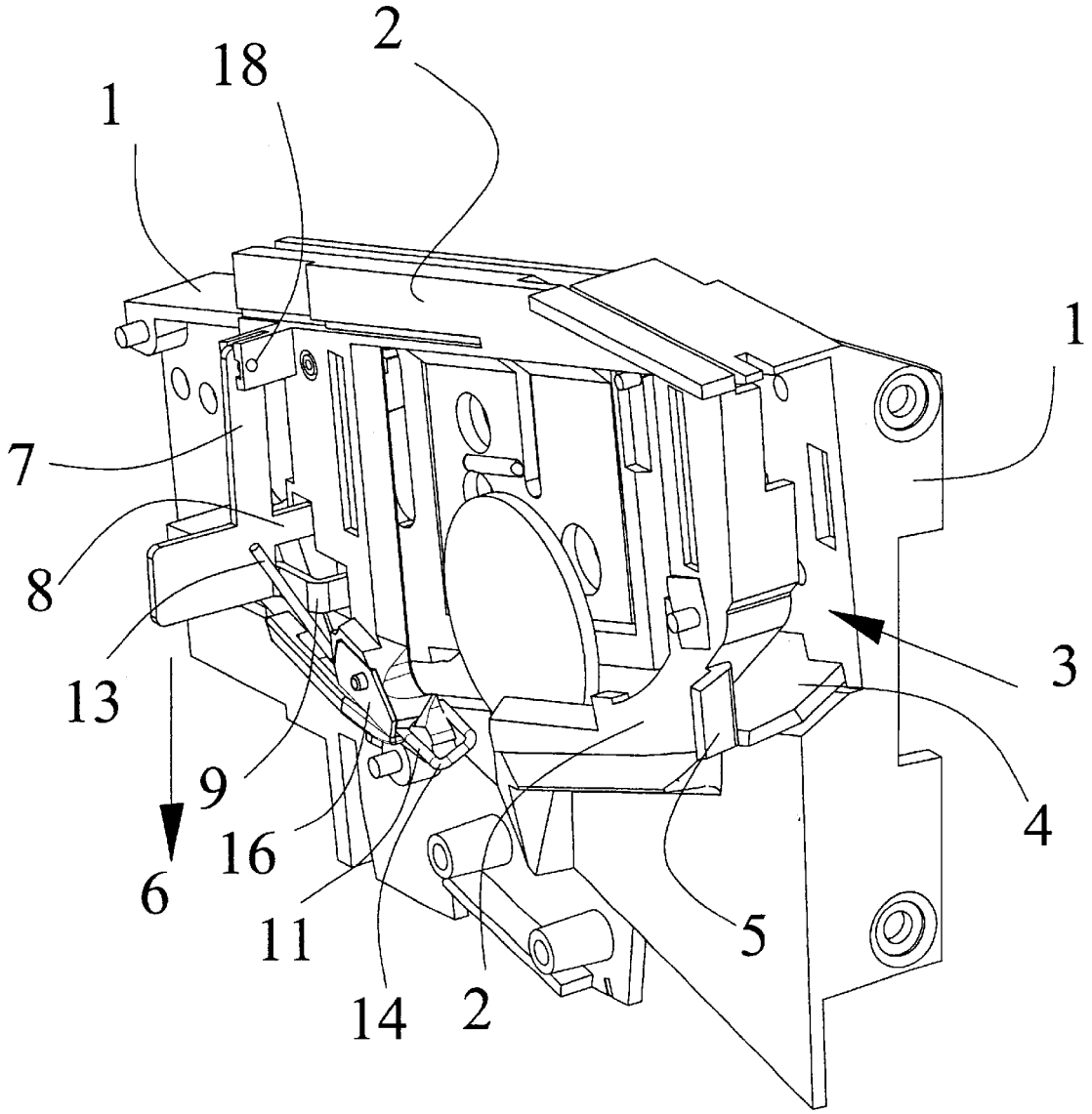
FIG. 1 a perspective view of a mechanical coin checker according to the invention, with an inserted coin, in which a portion of the covering flap has been omitted for better recognition, FIG. 2 a view of the coin checker according to FIG. 1 from another perspective, wherein again a portion of the flap and the basic body have been omitted for better recognition, FIG. 3 a sectional view through the bearing point of the detent wire, and FIG. 4 a perspective view of a coin checker according to FIG. 1 and FIG. 2, in which the coin has actuated the detent wire.

The mechanical coin checker represented in FIG. 1 has a basic body 1, on which a flap 2 is secured so as to be pivotable, in the embodiment shown, the flap 2 is shown open for a better view in the central region, so that the invention can be better recognised. To the basic body are secured a plurality of checking elements, not shown, for example magnets and the like. From the outside a coin channel is accessible via a coin slot, not shown, in direction 3, the coin entry channel having a running rail 4 connected to the basic body 1, and being delimited laterally by the basic body and by the flap 2 or respectively by elements which are secured to both parts. The flap 2 can be pivoted from outside by means of a control button which is connected to a pin or the like sliding along a sloping surface 5. The coin channel opens out into a coin acceptance channel for admissible and recognised coins, which channel is indicated by arrow 6 and into which fall the coins which have been recognised as admissible coins by the various checking devices. Below and to the side of the running rail 4 is provided a return channel, not shown, which is delimited in the lower region of FIG. 1 by a cover, and which leads non-admissible or unrecognised coins towards the outside.

At the flap 2, in front of the coin acceptance channel, a detent pawl 7 is rotatably mounted, which comprises a flat L-shaped metal strip with two integrally formed arms 6, 9, both arms pivoting into the coin channel when the flap 2 is opened via the sloping surface 5. Here the one arm 8 lies in the plane of the strip whilst the other arm 9 is bent away at least twice, preferably however 3 times, at an angle of 90°.

The running rail 4 itself serves together with the abutting flap 2 as a sensor for detecting coins or discs which are thinner than the admissible coins. To this end there is provided in the running direction of a coin in the lower running rail, at the side, a recess 10 which can be recognised in outline in FIG. 2. In the case of a coin which is too thin, the latter slides through the recess 10 and becomes stuck or falls into the return shaft lying below the recess. As an additional measure for actuating the detent pawl 7 and to prevent manipulation, a detent wire 11 is rotatably mounted at the flap 2. The detent wire 11 comprises three portions, a central portion 12 which serves to mount it, and two end portions 13, 14. As can be recognised from FIG. 3, there is worked out of the flap 2 a longitudinal groove 15 into which the central section 12 of the detent wire 11 is inserted and which is covered by a cover plate 16 securely connected to the flap 2, for example by riveting. The central portion 12 of the detent wire 11 is mounted in this groove 15 so as to be rotatable or pivotable about its longitudinal axis. The one end portion 13 is bent away obliquely upwards from the central portion 12 and the other end portion 14 is shaped into a U-shape. The coin checker when fitted is slightly inclined and the dimensions of the length of the end portion 13 take into account its gravity in such a way that the detent wire remains in stable in the rest state.

The detent wire 11 is inserted in the groove 15 in its rest position, which can be best recognised from FIG. 2, in such a way that the bent-up end portion 13 is opposite the arm 9 without influencing same, and that the other U-shaped end portion 14 is directed obliquely upwards, such that at least one member of the U-shape lies below the recess 10 or dips slightly into the latter. Thus the detent wire forms a rocker.

Figure 2:
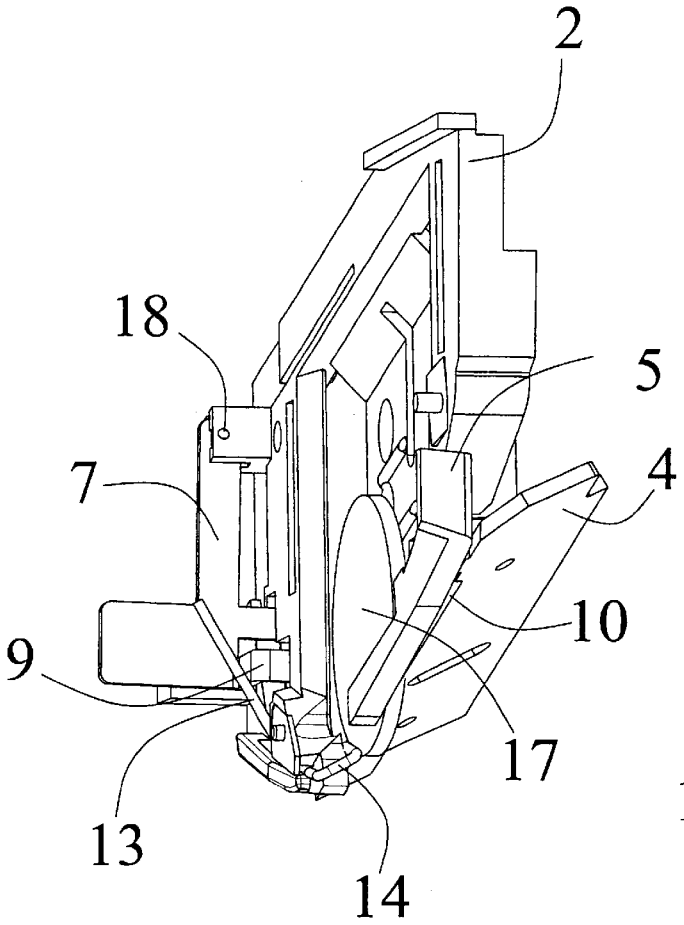
Figure 3:
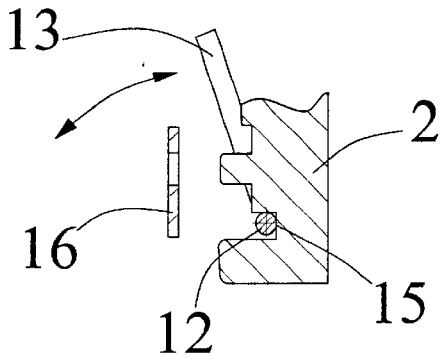
Figure 4:
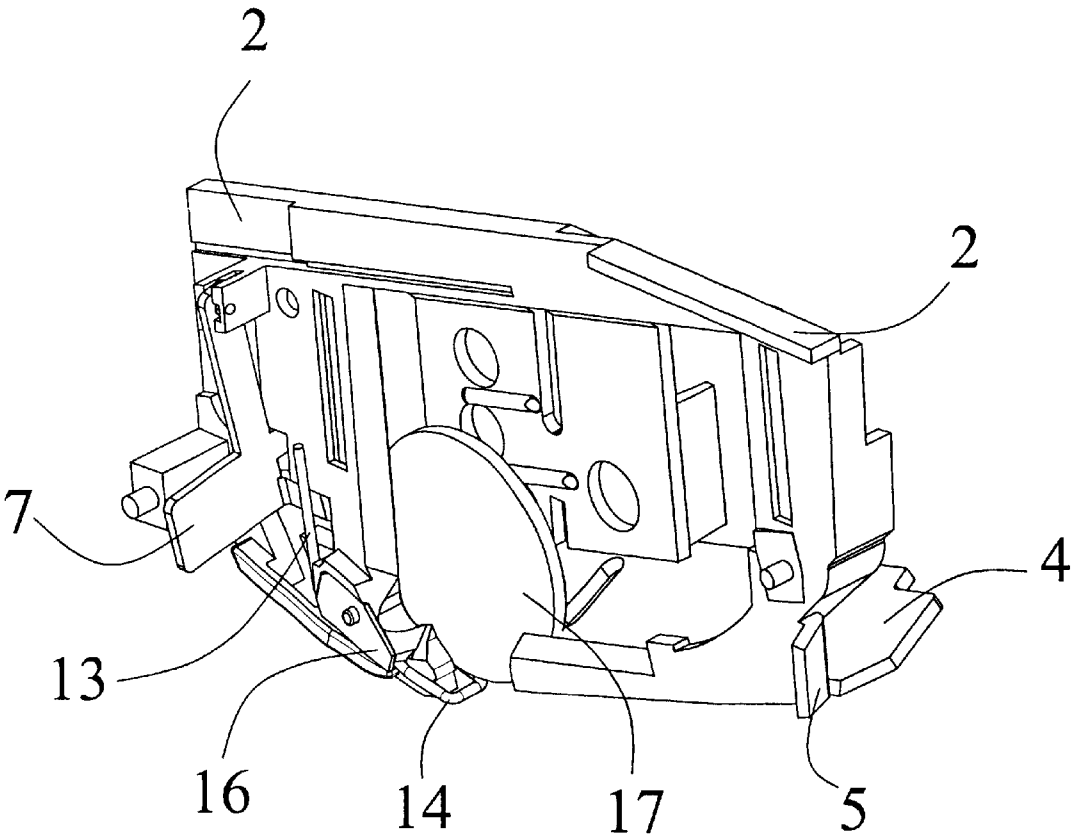

When a coin is introduced into the coin channel in coin entry direction 3, as a result of the inclined arrangement of the running rail 4 it rolls in an inclined position along the coin channel, and when the coin 17, as indicated in FIGS. 2 and 4, is too thin, it slips through the recess 10. Usually it becomes stuck there and could be pushed further with a long thin object which can be inserted from outside. However, as can be recognised in FIG. 4, this is prevented by the detent pawl 7. Through its weight namely the coin 17 presses on the U-shaped end portion 14 and pushes the latter downwards according to FIG. 2, by which means the central portion 12 rotates about its longitudinal axis and the bent-away end portion comes into contact with the arm 9 of the detent pawl, whereby the whole detent pawl pivots to the right in FIG. 2 about the bearing 18 of the detent pawl 7. This can be recognised in FIG. 4, i.e. the detent wire or the end portion 13 locks the detent pawl 7 in a position in which the arms 8, 9 engage in the coin channel, until the coin 17 presses on the U-shaped end portion 14. The coin 17 can now only be freed by the flap 2 being opened via the sloping surface 5 and the jammed coin 17 falling into the return shaft. Thereafter the detent wire 11 pivots back with the support of the detent pawl 7.

What is claimed is:

1. Mechanical coin checker having a coin channel which has a running rail for the coin to run down, in or at which channel checking arrangements are provided to check the properties of coins, having a coin acceptance shaft and a return shaft, disposed below the running rail, to return coins which are not accepted, the running rail having in the running direction of the coin a recess into which coins which are too thin slide and possibly fall into the return shaft, wherein in front of the coin acceptance shaft a detent pawl is disposed which is rotatably mounted at a flap forming a part of the coin channel, and a detent wire, which is pivotable about a portion of its longitudinal axis, co-operates with its one end region with the detent pawl and is disposed with its other end region below the recess, in such a way that when a coin slips through the recess, the detent wire pivots and takes the detent pawl with it into the coin channel to engage at least one integrally formed arm.

2. Mechanical coin checker according to claim 1, wherein the detent wire is rotatably mounted with its central region in a longitudinal groove, and the one end region is bent at an oblique angle away from the central region, and the other end region is bent in a U-shape.

3. Mechanical coin checker according to claim 2, wherein the longitudinal groove is formed in the flap and is covered by a plate.

4. Mechanical coin checker according to claim 1, wherein the detent wire is so mounted in the rest state that a portion of a U-shaped end region stands up at an oblique angle towards the recess and the detent wire forms a rocker, in such a way that when a coin hits the U-shaped other end region, the one obliquely-angled end region pivots and comes into contact with the arm of the detent pawl.

5. Mechanical coin checker according to claim 1, wherein the flap can be pivoted from the outside via a running slope, the arm of the detent pawl engaging in the coin channel.

6. Mechanical coin checker according to claim 1, wherein the detent pawl is an L-shaped flat metal strip and the arm is bent several times in a stepped manner at an angle preferably of roughly 90°.

* * * * *